US012134540B2

(12) United States Patent
Kolb

(10) Patent No.: US 12,134,540 B2
(45) Date of Patent: Nov. 5, 2024

(54) PROCESS FOR PRODUCING AT LEAST ONE FILAMENT, VAPOUR-DEPOSITING APPARATUS FOR CARRYING OUT SUCH A PROCESS AND FILAMENT-PRODUCTION INSTALLATION WITH SUCH A VAPOUR-DEPOSITING APPARATUS

(71) Applicant: Dietze & Schell Maschinenfabrik GmbH & Co. KG, Coburg (DE)

(72) Inventor: Detlef Kolb, Windeck (DE)

(73) Assignee: DIETZE & SCHELL MASCHINENFABRIK GMBH & CO. KG, Coburg (DE)

( * ) Notice: Subject to any disclaimer, the term of this patent is extended or adjusted under 35 U.S.C. 154(b) by 0 days.

(21) Appl. No.: 18/277,368

(22) PCT Filed: Mar. 1, 2022

(86) PCT No.: PCT/EP2022/055121
§ 371 (c)(1),
(2) Date: Aug. 15, 2023

(87) PCT Pub. No.: WO2022/184696
PCT Pub. Date: Sep. 9, 2022

(65) Prior Publication Data

US 2024/0124262 A1 Apr. 18, 2024

(30) Foreign Application Priority Data

Mar. 1, 2021 (DE) ..... 10 2021 104 890.7

(51) Int. Cl.
*B65H 51/16* (2006.01)
*B65H 54/88* (2006.01)
(Continued)

(52) U.S. Cl.
CPC ..... *B65H 54/88* (2013.01); *D01D 5/16* (2013.01); *D01D 10/02* (2013.01)

(58) Field of Classification Search
CPC ..... D01D 5/12; D01D 5/0855; D01D 10/02; D01D 13/02; D01D 5/16; D02J 1/222; B65H 54/88
See application file for complete search history.

(56) References Cited

U.S. PATENT DOCUMENTS 3,668,060 A * 6/1972 Polestak ..... C08G 75/08 428/394
3,679,786 A * 7/1972 Van Doornewaard ..... D01D 5/092 264/234

(Continued)

FOREIGN PATENT DOCUMENTS

CH 488844 A 4/1970
CN 206858702 U 1/2018

(Continued)

OTHER PUBLICATIONS

International Preliminary Report on Patentability for International Patent Application No. PCT/EP2022/055121, mailed Feb. 3, 2023, 5 pages.

(Continued)

*Primary Examiner* — Emmanuel S Luk
(74) *Attorney, Agent, or Firm* — Womble Bond Dickinson (US) LLP

(57) ABSTRACT

A method for producing at least one filament, comprises at least one stretching step in which the at least one filament is stretched, wherein the at least one filament is in a vapor-depositing region flown around by water vapor before and/or during a stretching, wherein at least one vapor parameter of the water vapor located in the vapor-depositing region is controlled so (Continued)

Figure 1:
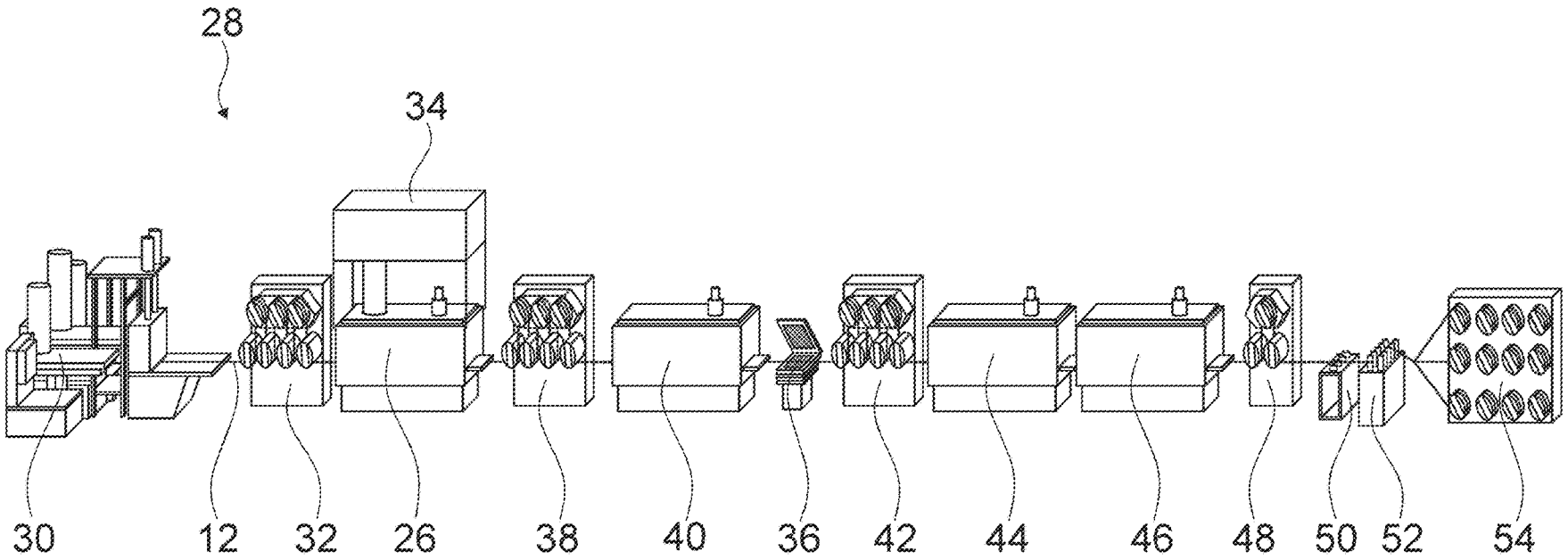

as to counteract a formation of droplets on the at least one filament, wherein the vapor parameter is monitored by at least one sensor element of a vapor-depositing apparatus, wherein a control or regulation unit of the vapor-depositing apparatus or of a filament-production installation comprising the vapor-depositing apparatus adjusts the vapor parameter such that a condensation of the water vapor on the filament is counteracted.

15 Claims, 4 Drawing Sheets

(51) Int. Cl.

| | |
|---|---|
| ***B65H 59/38*** | (2006.01) |
| ***D01D 5/16*** | (2006.01) |
| ***D01D 10/02*** | (2006.01) |

(56) References Cited

U.S. PATENT DOCUMENTS 4,053,678 A * 10/1977 Betz ..... D02G 1/127 428/394
4,098,864 A 7/1978 Morris et al.
5,518,670 A * 5/1996 Budenbender ..... D01D 5/0885 264/28
2011/0217404 A1* 9/2011 Dubus ..... D01D 5/0985 425/66
2016/0145780 A1* 5/2016 Chou ..... D01F 2/00 28/104
2018/0291528 A1* 10/2018 Scholl ..... D02J 1/223
2019/0284724 A1 9/2019 Kop et al.

FOREIGN PATENT DOCUMENTS

| | | | |
|---|---|---|---|
| CN | 111578255 | A | 8/2020 |
| CN | 213327958 | U | 6/2021 |
| DE | 102013020471 | A1 | 6/2015 |
| EP | 350945 | A2 | 1/1990 |

OTHER PUBLICATIONS

International Search Report for International Patent Application No. PCT/EP2022/055121, mailed Jun. 27, 2022, 2 pages.
Search Report for German Patent Application No. DE 10 2021 104 890.7, mailed Nov. 5, 2021, 2 pages.
Office Action received in related Chinese Application No. 202280018052.4, mailed Feb. 3, 2024, 11 pages.

* cited by examiner

PROCESS FOR PRODUCING AT LEAST ONE FILAMENT, VAPOUR-DEPOSITING APPARATUS FOR CARRYING OUT SUCH A PROCESS AND FILAMENT-PRODUCTION INSTALLATION WITH SUCH A VAPOUR-DEPOSITING APPARATUS

CROSS REFERENCE TO RELATED APPLICATIONS

The present patent application is based on and incorporates herein the German patent application DE 10 2021 104 890.7, filed on Mar. 1, 2021, and the international patent application PCT/EP2022/055121, filed on Mar. 1, 2022.

PRIOR ART

The invention concerns a method for producing at least one filament, in particular an artificial-lawn filament, a packaging tape or a monofilament, preferentially a cohort of filaments, a vapor-depositing apparatus for carrying out such a method and a filament-production installation with such a vapor-depositing apparatus.

A method has already been proposed which comprises at least one stretching step in which the at least one filament, in particular the artificial-lawn filament, the packaging tape or the monofilament, is stretched. The at least one filament, in particular the artificial-lawn filament, the packaging tape or the monofilament, is in a vapor-depositing region flown around by water vapor before and/or during a stretching.

From US 2019/0284724 A1 a method, a vapor-depositing apparatus and a filament-production installation for a production of at least one filament are already known.

The objective of the invention is in particular to provide a generic method and a generic vapor-depositing apparatus having improved properties with regard to consumption of resources, to a reproducibility of filament quality and to waste quantity. The objective is achieved according to the invention.

Advantages of the Invention

The invention is based on a method for producing at least one filament, in particular an artificial-lawn filament, a packaging tape or a monofilament, preferentially a cohort of filaments, with at least one stretching step in which the at least one filament, in particular the artificial-lawn filament, the packaging tape or the monofilament, is stretched, wherein the at least one filament, in particular the artificial-lawn filament, the packaging tape or the monofilament, is in a vapor-depositing region flown around by water vapor before and/or during a stretching.

It is proposed that at least one vapor parameter of the water vapor located in the vapor-depositing region, in particular in the form of dry vapor, is controlled so as to counteract a formation of droplets on the at least one filament, wherein the vapor parameter is monitored by at least one sensor element of a vapor-depositing apparatus, wherein a control or regulation unit of the vapor-depositing apparatus or of a filament-production installation comprising the vapor-depositing apparatus adjusts the vapor parameter such that a condensation of the water vapor, in particular the dry vapor, on the filament is counteracted. The filament may be produced as a continuous synthetic fiber, in particular for simultaneous further processing, or as a synthetic fiber having a defined length, in particular for further processing downstream. The method in particular comprises a raw material processing step. In the raw material processing step the at least one filament is produced, in particular as a monofilament or as a ribbon. The at least one filament may be produced as a one-component filament or as a multi-component filament, in particular as a multi-layered, filament, in particular as a bi-component or as a tri-component filament. Optionally several filaments are produced in parallel and are in particular further processed as a cohort. Preferably filaments are arranged so as to be spaced apart in the cohort. Particularly preferentially, during the method the filaments of a cohort are arranged in the same plane, in particular in a horizontal plane. Preferably, in the raw material processing step a base material with optional additives is melted by a raw material processing station of a filament-production installation and is formed into the filament, in particular extruded. The base material comprises, for example, polypropylene (PP), polyethylene (PE), in particular high-density polyethylene (PE-HD), linear-low-density polyethylene (PE-LLD) and/or low-density polyethylene (PE-LD), polyvinylchloride, polystyrene, polyurethane, polyethylene terephthalate, polyamide, polyester and/or another synthetic material deemed expedient by someone skilled in the art, in particular a petroleum-based synthetic material. Additives comprise, for example, UV stabilizers, pigments and/or heat stabilizers. The filament is in particular made of the base material by at least 50%, preferentially by more than 75%, preferably by at least 90%, particularly preferentially by more than 95%, with respect to a volume and/or a mass of the filament made of the base material. Optionally, in the raw material processing step at least one further base material having optional additives is, in particular separately from the base material, melted by the raw material processing station of the filament-production installation. The base material and the at least one further base material are preferably, in a melted state, extruded in each case with at least one extruder of an extrusion device of the raw material processing station and are brought together in a tool, in particular a spinning head, of the raw material processing station, and are formed into the filament. The at least one further base material preferentially comprises at least one of the materials already mentioned for the base material. The further base material may have the same composition as the base material or may have a different composition. The same or different additives may be added to the further base material and to the base material. Optionally, an adhesive agent, in particular an additional adhesive layer, is applied between the base material and the further base material. Preferably the base material and the at least one further base material together realize at least 50%, preferentially more than 75%, preferably at least 90%, particularly preferentially more than 95% of a total volume and/or of a total mass of the filament. The base material and the at least one further base material may comprise the same percentage or differently sized percentages of the total volume and/or of the total mass. The base material and the at least one further base material preferably form different regions of a cross section of the filament. For example, the base material forms a core of the filament and the further base material forms an at least partial, in particular complete, sheathing of the core in the cross section of the filament (core-sheath method). For example, the base material and the further base material form different parallel-arranged layers in the cross section of the filament (side-by-side method). In an unwound state of the filament, the cross section of the filament preferably extends perpendicularly to a maximal longitudinal extension of the filament in its unwound state. Preferably, all cross sections of the filament in the unwound state which are parallel to the aforementioned cross section are identical, at least in the range of a production accuracy of the method.

The method in particular comprises a winding step, in which the filament is wound onto a bobbin body by a winding station of the filament-production installation. In particular, each filament of the cohort of filaments is wound onto its own bobbin body by the winding station or by several winding stations of the filament-production installation. The filament is in particular produced in a continuous process, alternatively in an offline process. Preferably the method is configured to produce the filament, in particular in a stretched state of the filament, with a mass per unit length of less than 240 g/m, in particular of less than 160 g/m, particularly preferably of less than 80 g/m and especially preferentially of more than 0.01 g/m. The filament is in particular intended as a starting material for an artificial lawn, in particular as a pole yarn for a tufting of the artificial lawn. Alternatively, the filament is produced as a packaging tape or as a monofilament. "Configured" is in particular to mean specifically programmed, specifically designed and/or specifically equipped. By an object being configured for a certain function is in particular to be understood that the object fulfills and/or executes said certain function in at least one application state and/or operation state.

The stretching step is in particular carried out between the raw material processing step and the winding step. In particular, the filament-production installation comprises at least two filament conveyors which transport, in particular pull, the filament from the raw material processing station to the winding station along a transport path of the filament-production installation. Preferentially the filament conveyors subject the filament at least section-wise to a tensile strain along the transport path. Preferentially the filament conveyors stretch a section of the filament which is situated along the transport path between the filament conveyors, in particular by way of different conveying speeds of the filament conveyors. The transport path may in particular run along a straight line or may have a two-dimensional or three-dimensional course brought about by deflection elements of the filament-production installation.

The vapor-depositing region is preferentially arranged along the transport direction between the filament conveyors. Particularly preferentially the section that is stretched is located within the vapor-depositing region. Alternatively, the section that is stretched is located in a stretching region adjoining a side of the vapor-deposition region that faces towards the winding apparatus or partially overlaps with the vapor-depositing region on this side. The vapor-depositing region is in particular delimited by a vapor-depositing chamber of a vapor-depositing apparatus of the filament-production installation. Preferentially the vapor-depositing apparatus creates in the vapor-depositing region an overpressure with respect to the atmosphere. In particular, the vapor-depositing apparatus sets in the vapor-depositing region, at least for a duration of the method, a continuous flow of the water vapor, in particular of the dry vapor, across the filament.

According to the invention, the vapor parameter is monitored by at least one sensor element of the vapor-depositing apparatus. The vapor parameter may in particular be monitored in the vapor-depositing region, before admitting the water vapor, in particular the dry vapor, into the vapor-depositing region, and/or after an outlet of the water vapor, in particular the dry vapor, from the vapor-depositing region. Preferably the vapor parameter is a state variable of the water vapor, in particular the dry vapor, for example a temperature, a pressure, a humidity content, or the like, and/or a flow parameter, for example a volumetric flow rate, a flow rate, or the like. The vapor parameter may be registered directly by means of the sensor element or may be determined indirectly depending on sensor data of the sensor element, in particular according to the invention by a control or regulation unit of the filament-production installation or of the vapor-depositing apparatus. By a "control or regulation unit" is in particular a unit to be understood which comprises at least one control electronics unit. By a "control electronics unit" is in particular a unit to be understood which has a processor unit and a memory unit as well as an operation program stored in the memory unit. Preferentially the vapor parameter is controlled, particularly preferably regulated, by the control or regulation unit. The vapor-depositing apparatus is in particular configured for an even heating of the section of the filament that is to be stretched. According to the invention, the control or regulation unit is configured to adjust the vapor parameter such that a condensation of the water vapor, in particular the dry vapor, on the filament can be counteracted. In particular, by adjusting the vapor parameter, the control or regulation unit maintains a humidity of the water vapor below a threshold value, in particular below a relative humidity of 100%, preferentially below a relative humidity of 50%, preferably below a relative humidity of 25%, at an entry temperature of the filament into the vapor-depositing region. Particularly preferentially the water vapor is fed into the vapor-depositing region as a dry vapor. Optionally the control or regulation unit controls or regulates at least one process parameter of the vapor-depositing region, for example a wall temperature of the vapor-depositing chamber, in order to counteract a droplet formation within the vapor-depositing region, in particular within components of the vapor-depositing apparatus which are fluidically connected with the vapor-depositing region. Preferably, a control or regulation of the at least one process parameter allows counteracting a cooling of the water vapor, in particular the dry vapor, when contacting the vapor-depositing chamber. Preferably, the vapor-depositing region, in particular the vapor-depositing chamber, is designed so as to support a laminar flow of the water vapor, in particular the dry vapor, in particular to counteract turbulences and accumulation regions of the water vapor, in particular the dry vapor.

The implementation according to the invention allows keeping a risk of a formation of droplets on the filament at an advantageously low level. In particular, a risk of a local cooling of the filament, in particular of inhomogeneous temperature distribution within the filament, can be kept advantageously low. It is in particular advantageously possible to dispense with an additional device for drying the filament. In particular, advantageously even hardening of the filament is achievable. In particular, an advantageously constant quality of the filament is achievable. It is in particular possible to realize the method with advantageously low water consumption. In particular, advantageously fast stretching of the filament is possible. In particular, advantageously high throughput of the filament-production installation is attainable. Furthermore, it is advantageously possible to flexibly adapt physical parameters, in particular the vapor parameter, like a temperature of the vapor, a pressure of the vapor, a vapor quantity and/or a vapor distribution in the vapor-depositing chamber, to a material type and/or to a composition of the filament. In particular, one-component filaments and multi-component filaments can be produced in an advantageously reliable manner.

Furthermore, it is proposed that for an adjustment of the vapor parameter, the water vapor, in particular the dry vapor, is heated to a temperature of more than 125° C. before entry into the vapor-depositing region. According to the invention, a vapor generator of the vapor-depositing apparatus vaporizes water in order to produce the water vapor, in particular the dry vapor. Especially preferentially the water vapor, in particular the dry vapor, is heated by the vapor generator to a temperature of more than 150° C., particularly preferably to a temperature of more than 170° C. Preferentially the water vapor, in particular the dry vapor, is heated by the vapor generator to a temperature of less than 400° C., in particular of less than 350° C., particularly preferably of less than 300° C. Alternatively, the vapor-depositing apparatus obtains the water vapor, in particular the dry vapor, from an external vapor source. According to the invention, the vapor-depositing apparatus optionally comprises a heating and/or cooling aggregate for an adaption of the temperature of the water vapor, in particular the dry vapor, obtained in particular from an external vapor source, before entry into the vapor-depositing region. The implementation according to the invention allows keeping a humidity of the water vapor advantageously low.

It is also proposed that for an adjustment of the vapor parameter, the water vapor is overheated before entry into the vapor-depositing region, in particular in order to generate dry vapor. Particularly preferentially the vapor generator produces the water vapor as a dry vapor. Preferably a vaporizer of the vapor generator produces a saturated vapor by heating water. Preferentially a superheater of the vapor generator produces the water vapor that is realized as a dry vapor by further heating of the saturated vapor. Preferably the vapor generator comprises electrical vapor-generator heating elements for a heating of the water and/or for an overheating of the water vapor. In particular, the control or regulation unit adjusts the vapor-generator heating elements for a regulation of a temperature of the water vapor, in particular the dry vapor. In particular, when let into the vapor-depositing region, a mass ratio of gasiform water in the water vapor to a total mass of the water vapor is more than 0.9, preferentially more than 0.95, particularly preferentially more than 0.99. The implementation according to the invention allows keeping a risk of precipitation of liquid water contained in the water vapor at an advantageously low level.

Beyond this it is proposed that in at least one method step, a temperature which the water vapor, in particular the dry vapor, is brought to before entry into the vapor-depositing region is adjusted depending on the vapor parameter of the vapor-depositing region. Preferably the control or regulation unit predetermines the temperature depending on the vapor parameter which the water vapor, in particular the dry vapor, is brought to before entry into the vapor-depositing region. In particular, the control or regulation unit increases the temperature in order to lower a risk of droplet formation. Preferably the control or regulation unit controls or regulates an adaption of a pressure of the water vapor, in particular the dry vapor, via an inlet valve of the vapor-depositing apparatus. However, direct adaption of the temperature of the water vapor, in particular the dry vapor, is also conceivable, for example via the vapor generator and/or via the heating and/or cooling aggregate. The control or regulation unit varies the temperature in particular in such a way that the water vapor, in particular the dry vapor, when exiting the vapor-depositing region has a minimal temperature, and is in particular still present as dry vapor. In particular, the control or regulation unit varies the temperature of the water vapor, in particular the dry vapor, upstream of the inlet valve between 125° C. and 400° C., preferentially between 150° C. and 350° C., particularly preferentially between 170° C. and 300° C. In particular, the control or regulation unit lowers the temperature in order to save energy and/or to reduce thermo-mechanical strain of the filament, in particular if the risk of droplet formation is below a tolerance value. In particular, the control or regulation unit judges the risk of droplet formation at least on the basis of the vapor parameter and optionally on the basis of further parameters. Further parameters in particular comprise the process parameter of the vapor-depositing region, a filament parameter of the filament, in particular a filament temperature, a bending strength of the filament or the like, an environment parameter of an environment of the vapor-depositing apparatus, in particular of the transport path, for example an ambient temperature, an ambient pressure, an air humidity or the like. Thanks to the implementation according to the invention, the method is advantageously capable of responding to production conditions in an advantageously flexible manner. It is in particular possible to keep a risk of droplet formation advantageously low despite adverse production conditions. In particular, in the case of favorable production conditions, energy consumption and/or water consumption can be kept advantageously low.

Beyond this it is proposed that the water vapor, in particular the dry vapor, is expanded upon entry into the vapor-depositing region. Preferably the vapor generator or the external vapor source subjects the water vapor, in particular the dry vapor, to a pressure of more than 2 bar, in particular of more than 3 bar. Preferentially the vapor generator or the external vapor source subjects the water vapor, in particular the dry vapor, with a pressure of less than 11 bar, in particular less than 7 bar, particularly preferably less than 4 bar. The inlet valve of the vapor-depositing apparatus preferably adjusts a pressure of the water vapor, in particular the dry vapor, in the vapor-depositing region. In particular, the inlet valve sets a pressure of less than 2 bar, preferentially of less than 1 bar, particularly preferentially of less than 0.5 bar, above standard atmosphere. Preferably the control or regulation unit adjusts an expansion of the water vapor, in particular the dry vapor, by means of the inlet valve in such a way that the temperature of the water vapor, in particular the dry vapor in the vapor-depositing region remains at least above 100° C., preferentially above 110° C., particularly preferentially above 115° C. Preferably the control or regulation unit adjusts by means of the inlet valve—in particular depending on the base material used and/or the at least one further base material for the filament—an expansion of the water vapor, in particular the dry vapor, such that the temperature of the water vapor, in particular the dry vapor, in the vapor-depositing region gets adjusted below 200° C., in particular below 175° C., preferentially below 150° C. The implementation according to the invention allows producing the water vapor, in particular the dry vapor, and transporting the water vapor, in particular the dry vapor, to the vapor-depositing region in an advantageously efficient manner.

It is further proposed that an inlet valve for letting the water vapor, in particular the dry vapor, into the vapor-depositing region is regulated depending on the vapor parameter. In particular, the control or regulation unit regulates the pressure within the vapor-depositing region by means of the inlet valve, in particular depending on the vapor parameter. Preferably the inlet valve is embodied as a regulating valve. Especially preferentially the inlet valve is embodied as a pneumatic regulating valve. The implementation according to the invention allows adapting a pressure adaption of the water vapor, in particular the dry vapor, to the vapor parameter in an advantageously flexible manner during a feeding into the vapor-depositing region. In particular, a risk of droplet formation can be kept advantageously low.

Beyond this it is proposed that a temperature of the water vapor, in particular the dry vapor, in the vapor-depositing region is maintained above a condensation temperature of the water vapor, in particular the dry vapor. In particular, the control or regulation unit regulates the temperature of the water vapor, in particular by a controlling of the vapor generator, of the inlet valve and optionally of an electric heating element of the vapor-depositing apparatus. The heating element is preferably arranged at the vapor-depositing chamber, in particular on an outer wall of the vapor-depositing chamber, in particular for heating a wall of the vapor-depositing chamber. Optionally the heating element is embedded or integrated in a wall of the vapor-depositing chamber. Particularly preferentially the heating element is arranged in places of the vapor-depositing chamber which have a high risk of droplet formation, in particular due to cold bridges and/or accumulation regions for the water vapor, in particular the dry vapor, like in particular corners, inlets and/or outlets for the water vapor, in particular the dry vapor, and/or for the filament. Thanks to the implementation according to the invention, a risk of a condensation of the water vapor, in particular the dry vapor, can be kept advantageously low.

It is furthermore proposed that the water vapor, in particular the dry vapor, is actively removed, in particular suctioned, out of the vapor-depositing region. Particularly preferentially the water vapor, in particular the dry vapor, is suctioned from the vapor-depositing region by means of a ventilator of the vapor-depositing apparatus. Especially preferentially the water vapor, in particular the dry vapor, is removed from the vapor-depositing region in more than one place, in particular in at least two places. In particular, vapor outlets of the vapor-depositing chamber are arranged in different half-chambers of the vapor-depositing chamber, said half-chambers being in particular arranged next to each other along the transport path. In particular, the vapor outlets are arranged at the same surface, preferably a bottom, alternatively a ceiling, of the vapor-depositing chamber. Alternatively, the vapor outlets are arranged in sidewalls of the vapor-depositing chamber which are, in particular along the transport path, situated opposite each other. Preferably the vapor outlets are arranged in surroundings presenting a high risk of droplet formation, for example due to cold bridges, accumulation regions for the water vapor, in particular the dry vapor, or the like. Particularly preferably the vapor outlets face toward an entry opening and/or exit opening of the vapor-depositing chamber, which are/is configured for a passage of the filament through the vapor-depositing chamber. Alternatively to a plurality of vapor outlets, a single vapor outlet of the vapor-depositing chamber extends over a substantially entire longitudinal extension of the vapor-depositing chamber along the transport path of the filament. Preferably the control or regulation unit adjusts the ventilator depending on the vapor parameter and/or depending on an adjustment of the inlet valve. The ventilator is in particular configured to delimit a maximal residence time, in particular a heat output connected thereto, of the water vapor, in particular the dry vapor, within the vapor-depositing region. The implementation according to the invention allows advantageously accurate controlling of a flow of the water vapor, in particular the dry vapor, through the vapor-depositing region. In particular, a risk of turbulences within the vapor-depositing region can be kept advantageously low. Beyond this, it is possible to obtain advantageously high personal safety for an operator of the vapor-depositing apparatus.

In order to achieve a homogeneous distribution of the water vapor, in particular the dry vapor, it is moreover proposed that the water vapor, in particular the dry vapor, is let into the vapor-depositing region in distributed fashion via several vapor inlets. Preferably the vapor-depositing chamber has an inlet region, in which the water vapor, in particular the dry vapor, is let into the vapor-depositing chamber. Preferably the vapor-depositing apparatus comprises a distributor system, which is in particular arranged in the inlet region. The distributor system is in particular connected fluidically to the inlet valve. In particular, the distributor system comprises a plurality of openings for a passage of the water vapor, in particular the dry vapor, from the inlet region into the vapor-depositing region. In particular, the distributor system distributes the water vapor, in particular the dry vapor, homogeneously in the vapor-depositing region. A main extension plane of the distributor system preferably extends at least substantially parallel to the transport path, in particular at least to the section of the transport path in the vapor-depositing region. By a "main extension plane" of a structural unit is in particular a plane to be understood which is parallel to a largest side surface of a smallest imaginary rectangular cuboid just still enclosing the structural unit, and in particular extends through the center of the rectangular cuboid. "Substantially parallel" is here in particular to mean an orientation of a direction relative to a reference direction, in particular in a plane, the direction having a deviation from the reference direction that is in particular smaller than 8°, advantageously smaller than 5° and especially advantageously smaller than 2°. Preferably the vapor-depositing chamber comprises a conveying unit for guiding the water vapor, in particular the dry vapor, from the inlet valve to the distributor system. Optionally the distributor system is implemented by the conveying unit. For the formation of the distributor system, the conveying unit for example has a planar subregion, in particular a ladder-shaped, rake-shaped, serpentine-shaped or spiral-shaped subregion, in which the several vapor inlets, in particular openings or nozzles, are arranged for an inlet of the water vapor, in particular the dry vapor, into the inlet region. Preferably the distributor system comprises at least two vapor inlets which are arranged at least substantially parallel to the transport path. Preferably the distributor system comprises at least two vapor inlets which are arranged transversally to the transport path. The implementation according to the invention allows achieving an advantageously homogeneous distribution of the water vapor, in particular the dry vapor, in the vapor-depositing region.

It is further proposed that the method comprises a further stretching step, before and/or during which the at least one filament, in particular the artificial-lawn filament, the packaging tape or the monofilament, is flown around by hot air. In particular, the filament-production installation comprises at least one further filament conveyor, which is arranged along the transport path downstream of the aforementioned filament conveyors. In particular, the further stretching step is carried out by the further filament conveyor and one of the two filament conveyors, in particular by way of different conveying speeds of the participating filament conveyors. In particular, the filament-production installation comprises a hot-air oven, which is arranged along the transport path between the further filament conveyor and one of the two filament conveyors. In particular, the further stretching step is carried out with hot air after the stretching step with water vapor, in particular dry vapor. Alternatively, the further stretching step is carried out with water vapor, in particular dry vapor, in particular analogously to the stretching step. The implementation according to the invention enables an advantageously reliable stretching of the filament.

Furthermore, it is proposed that the method comprises a fixing step, during which the at least one filament, in particular the artificial-lawn filament, the packaging tape or the monofilament, is flown around by hot air or water vapor, in particular dry vapor. The fixing step is in particular carried out between the stretching step, in particular the further stretching step, and the winding step. The fixing step is in particular carried out by a fixing station of the filament-production installation. In particular, the fixing station comprises a closed-off fixing region which the transport path runs through and in which the hot air or the water vapor, in particular the dry vapor, flows around the filament. Optionally the method comprises a further fixing step, which is carried out by a further fixing station of the filament-production installation. The further fixing step is in particular carried out between the fixing step and the winding step. In particular, the further fixing step is omitted if in the first fixing step water vapor, in particular dry vapor, is used for a fixing of the filament. Preferably, if water vapor, in particular dry vapor, is used, a shorter fixing region is used for the fixing step than if hot air is used. The water vapor, in particular the dry vapor, for the fixing step may be generated by the same vapor generator as the water vapor, in particular the dry vapor, for the stretching step, or may be generated by a further vapor generator of the vapor-depositing apparatus. The implementation according to the invention advantageously allows attaining homogeneous material properties of the filament.

Beyond this, a vapor-depositing apparatus, in particular the aforementioned vapor-depositing apparatus, for an, in particular the aforementioned, filament-production installation, in particular an extrusion spinning installation or a synthetic stretching installation, for the production of at least one, in particular the aforementioned, filament, in particular an artificial-lawn filament, a packaging tape or a monofilament, following a method according to the invention, is proposed, with at least one control or regulation unit, which is configured to adjust the vapor parameter such that a condensation of the water vapor, in particular the dry vapor, on the filament can be counteracted, and with at least one vapor generator or at least one heating and/or cooling aggregate, the vapor generator being configured to vaporize water for a production of the water vapor, in particular the dry vapor, the heating and/or cooling aggregate being configured to adapt, before entry into the vapor-depositing region, the temperature of the water vapor, in particular the dry vapor, in particular the temperature of the water vapor, in particular the dry vapor, obtained from an external vapor source. The vapor-depositing apparatus in particular comprises a vapor-depositing chamber for receiving the section of the filament that is to be stretched. The vapor-depositing chamber in particular has a longitudinal axis oriented at least substantially parallel to the transport path. The vapor-depositing chamber surrounds the section of the transport path in particular in a cylindrical shape, wherein the longitudinal axis is in particular equivalent to a cylinder axis. Preferably the vapor-depositing chamber comprises a framing for a horizontal alignment of the longitudinal axis. In particular, the vapor-depositing chamber comprises the distributor system. The main extension plane of the distributor system is in particular arranged in the interior of the vapor-depositing chamber at least substantially parallel to the longitudinal axis. In particular, the distributor system divides the interior of the vapor-depositing chamber into the vapor-depositing region and the inlet region. The vapor-depositing chamber in particular comprises the conveying unit, which opens into the inlet region. The vapor-depositing apparatus in particular comprises the inlet valve, which is connected to the conveying unit. The vapor-depositing chamber in particular comprises at least two vapor outlets. The vapor outlets are in particular arranged at the vapor-depositing region. In particular, in the case of a horizontal orientation of the longitudinal axis, the vapor outlets are arranged at the bottom, alternatively at the ceiling, of the vapor-depositing chamber. The vapor-depositing apparatus in particular comprises the ventilator for a suctioning of the water vapor, in particular the dry vapor, out of the vapor-depositing region. Preferably the vapor-depositing apparatus comprises the at least one sensor element for a registration of the vapor parameter. By the implementation according to the invention, a vapor-depositing apparatus can be provided which is advantageously operable in a manner that is cost-efficient and is gentle on resources.

Moreover, a filament-production installation, in particular the aforementioned filament-production installation, in particular an extrusion spinning installation or a synthetic stretching installation, for the production of at least one, in particular the aforementioned, filament, in particular an artificial-lawn filament, a packaging tape or a monofilament, with a vapor-depositing apparatus according to the invention and with at least one raw material processing station for spinning the filament, is proposed. Optionally the filament-production installation comprises an additional vapor-depositing apparatus, which is in particular arranged downstream of the vapor-depositing apparatus, in particular for a repetition of the stretching step. Optionally the filament-production installation comprises at least one, preferably one or two, further vapor-depositing apparatus/es and/or at least the hot-air oven and optionally a further hot-air oven, for carrying out the further stretching step with water vapor, in particular dry vapor, or with hot air. The raw material processing station in particular comprises a dosing device for a dosing of the base material and optionally of the additives. The raw material processing station in particular comprises at least one further dosing station for a dosing of the at least one further base material and optionally of the additives. The raw material processing station in particular comprises a melting device for a melting of the base material and optionally of the additives. The raw material processing station in particular comprises a further melting device for a melting of the further base material and optionally of the additives. The raw material processing station preferably comprises an extrusion apparatus for a shaping of the filament from the molten base material and optionally from the at least one further base material. Preferentially the raw material processing station comprises at least one bain-marie for a cooling of the extruded filament. The filament-production installation in particular comprises at least the two filament conveyors and the further filament conveyor for a transport and for the stretching of the filament along the transport path. The filament-production installation in particular comprises the fixing station and optionally the further fixing station. Optionally the filament-production installation comprises at least one fibrillation device for a fibrillation of the filament that is realized as a ribbon. Preferably the filament-production installation comprises at least the winding apparatus for a winding of the filament onto the bobbin body. The filament-production installation preferably comprises the vapor generator for a production of the water vapor, in particular the dry vapor. The vapor generator is preferably connected fluidically to the vapor-depositing region via the inlet valve. The filament-production installation preferentially comprises the control or regulation unit for an adjustment of the vapor parameter, in particular for a controlling of the inlet valve and/or of the vapor generator. The implementation according to the invention allows providing a filament-production installation that is advantageously resource-friendly, has an advantageously high throughput, and is capable of producing filaments of advantageously constant quality.

The method according to the invention, the vapor-depositing apparatus according to the invention and/or the filament-production installation according to the invention shall herein not be limited to the application and implementation described above. In particular, in order to fulfill a functionality that is described here, the method according to the invention, the vapor-depositing apparatus according to the invention and/or the filament-production installation according to the invention may comprise a number of individual elements, components and units as well as method steps that differs from a number given here. Moreover, with regard to the value ranges given in the present disclosure, values situated within the limits mentioned shall also be considered as disclosed and as applicable according to requirements.

DRAWINGS

Further advantages will become apparent from the following description of the drawings. In the drawings an exemplary embodiment of the invention is illustrated. The drawings, the description and the claims contain a plurality of features in combination. Someone skilled in the art will purposefully also consider the features separately and will find further expedient combinations.

Figure 2:
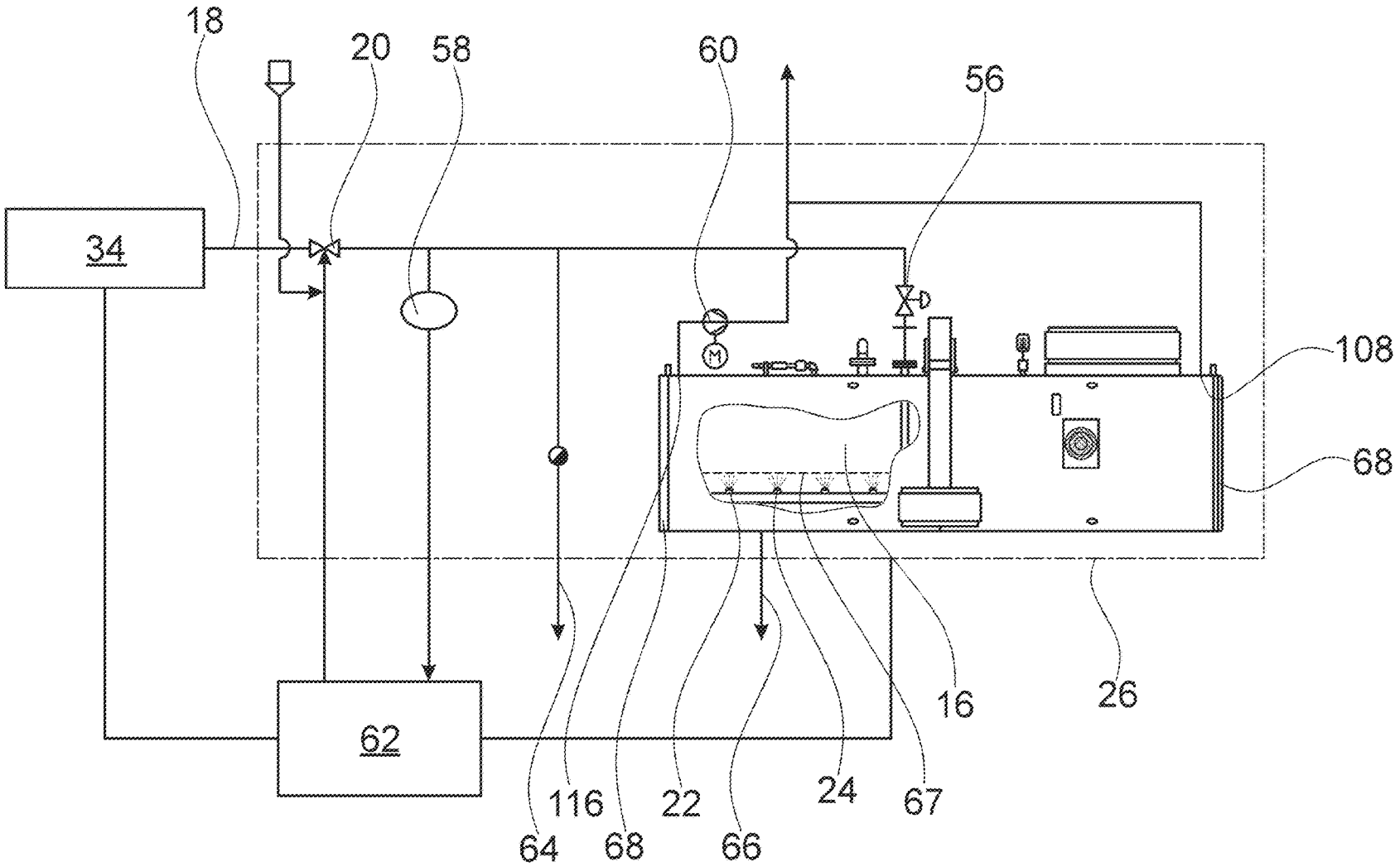
Figure 3:
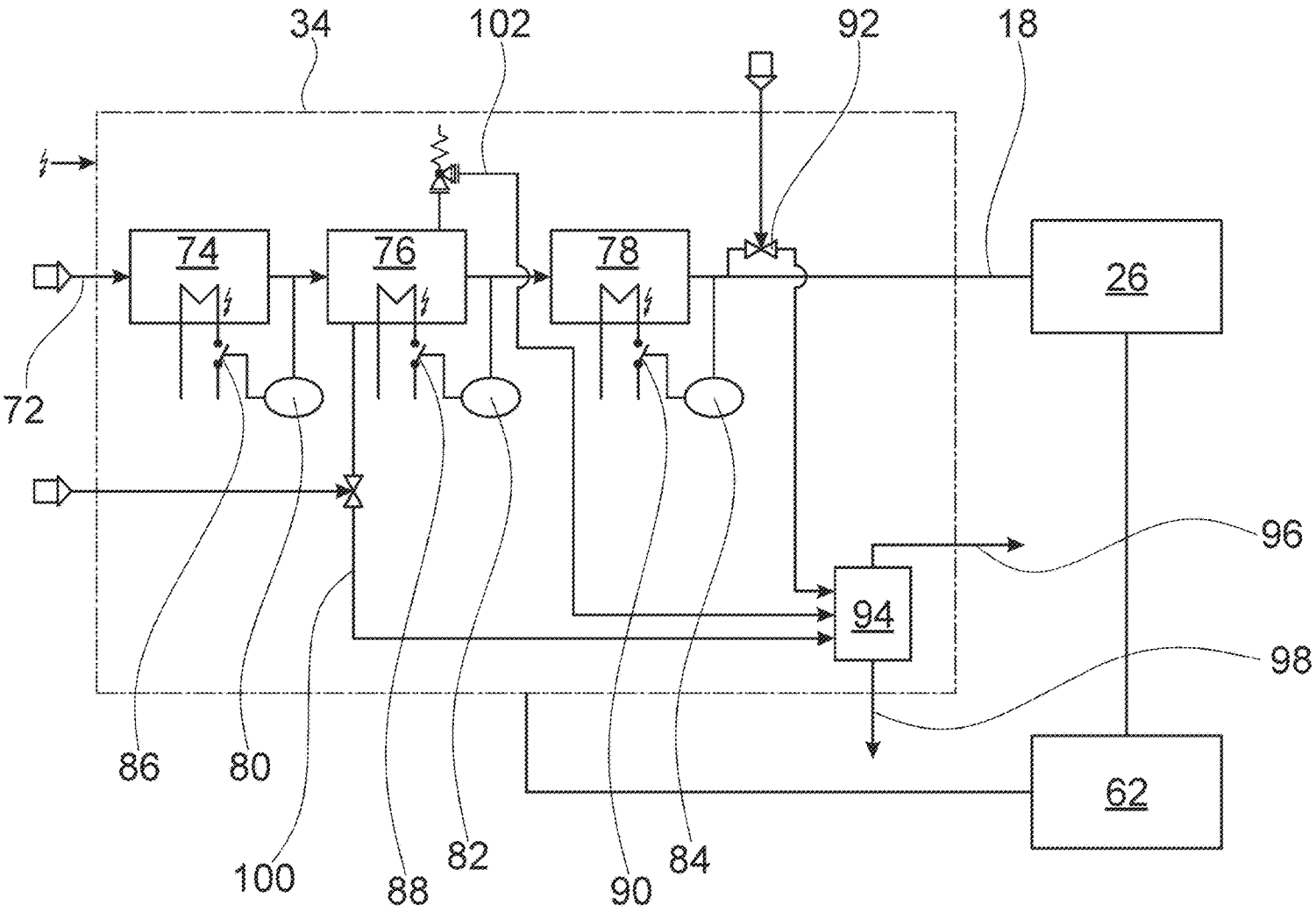
Figure 4:
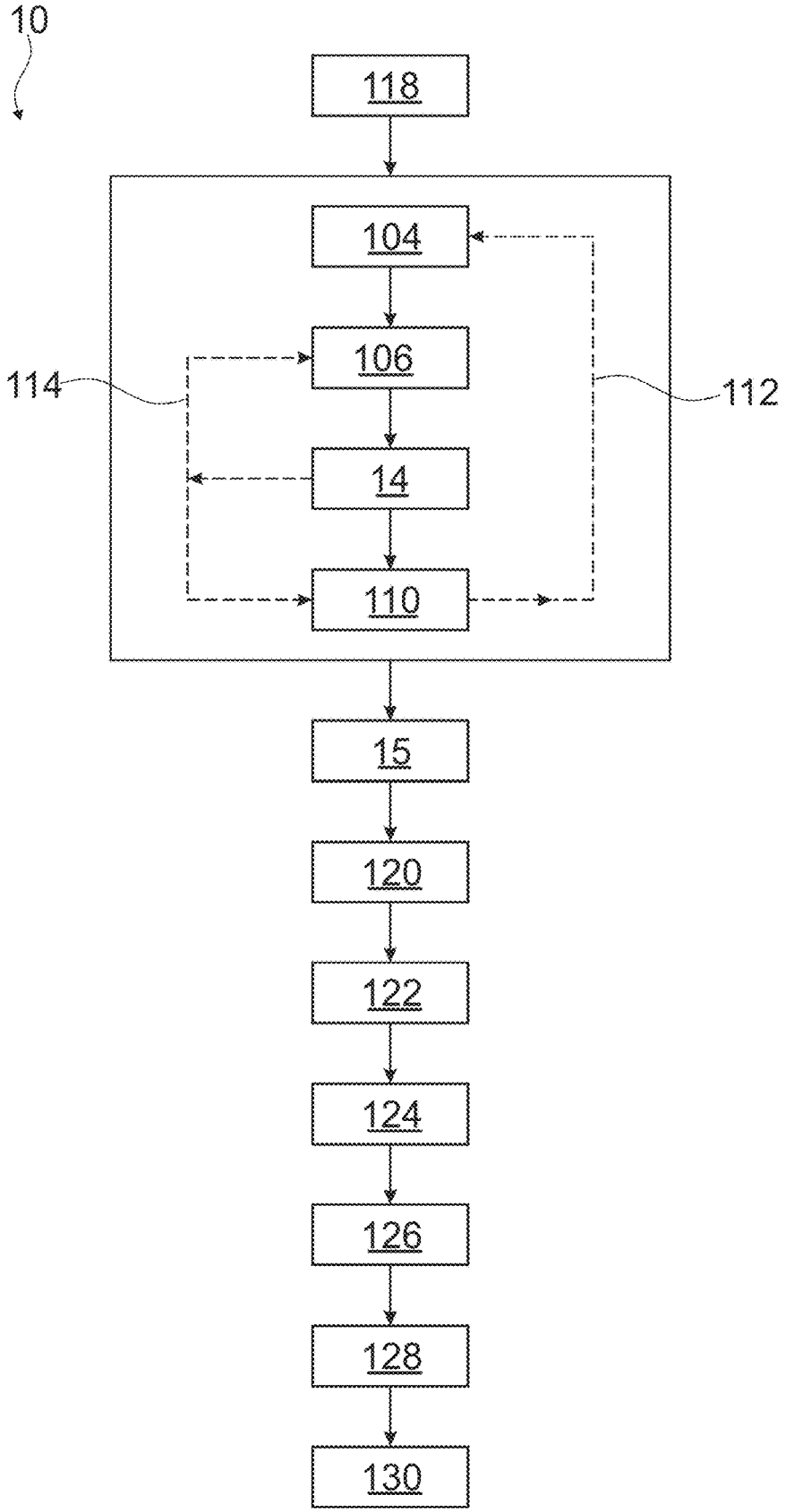

It is shown in:

FIG. 1, a schematic illustration of a filament-production installation according to the invention, FIG. 2, a schematic illustration of a vapor-depositing apparatus according to the invention, FIG. 3, a schematic illustration of a vapor generator of the filament-production installation, and FIG. 4, a schematic flow chart of the method according to the invention.

DESCRIPTION OF THE EXEMPLARY EMBODIMENT

FIG. 1 shows a filament-production installation 28. The filament-production installation 28 is in particular embodied as an extrusion-spinning installation. The filament-production installation 28 is in particular configured for the production of at least one filament 12. The filament 12 is in particular embodied as an artificial-lawn filament, as a packaging tape or as a monofilament. The filament-production installation 28 comprises at least one raw material processing station 30. The filament-production installation 28 in particular comprises a frontward filament conveyor 32. The filament-production installation 28 in particular comprises a vapor-depositing apparatus 26. The filament-production installation 28 in particular comprises a rearward filament conveyor 38. The filament-production installation 28 preferably comprises a hot-air oven 40. The filament-production installation 28 optionally comprises a fibrillation device 36. Preferably the filament-production installation 28 comprises a further filament conveyor 42. The filament-production installation 28 preferably comprises at least one fixing station 44. Optionally the filament-production installation 28 comprises at least one further fixing station 46. The filament-production installation 28 in particular comprises an additional filament conveyor 48. The filament-production installation 28 preferably comprises a coating device 50. The coating device 50 is in particular realized as a roller preparator. Preferably the filament-production installation 28 comprises at least one cohort sorter 52. Preferably the filament-production installation 28 comprises at least one winding apparatus 54. Preferably the filament-production installation 28 comprises at least one vapor generator 34.

The filament-production installation 28 in particular comprises a control or regulation unit 62 for implementing a method 10 for the production of the at least one filament 12, which will be explained in detail in FIG. 4. The frontward filament conveyor 32, the rearward filament conveyor 38, the further filament conveyor 42 and/or the additional filament conveyor 48 are in particular configured for a transport of the filament 12 along a transport path from the raw material processing station 30 to the winding apparatus 54. The frontward filament conveyor 32 is arranged along the transport path in particular between the raw material processing station 30 and the vapor-depositing apparatus 26. The vapor-depositing apparatus 26 is preferably arranged along the transport path between the frontward filament conveyor 32 and the rearward filament conveyor 38. The vapor generator 34 is fluidically connected in particular with the vapor-depositing apparatus 26. The vapor generator 34 is, for example, arranged at a level above, sidewise or below the transport path. Optionally the vapor generator 34 and the vapor-depositing apparatus 26 are arranged directly adjoining each other and/or in a shared housing. The rearward filament conveyor 38 is in particular arranged along the transport path between the hot-air oven 40 and the further filament conveyor 42. The fibrillation device 36 is in particular arranged along the transport path between the hot-air oven 40 and the further filament conveyor 42. The further filament conveyor 42 is preferably arranged along the transport path between the hot-air oven 40, in particular the fibrillation device 36, and the fixing station 44. The fixing station 44 is preferably arranged along the transport path between the further filament conveyor 42 and the further fixing station 46, in particular the additional filament conveyor 48. The further fixing station 46 is preferably arranged along the transport path between the fixing station 44 and the additional filament conveyor 48. The additional filament conveyor 48 is preferably arranged along the transport path between the coating device 50 and the fixing station 44, in particular the further fixing station 46. The coating device 50 is preferably arranged along the transport path between the additional filament conveyor 48 and the cohort sorter 52. The cohort sorter 52 is preferably arranged along the transport path between the coating device 50 and the winding apparatus 54.

FIG. 2 shows the vapor-depositing apparatus 26. The vapor-depositing apparatus 26 in particular comprises at least one vapor-depositing chamber which delimits a vapor-depositing region 16. In particular, the vapor-depositing apparatus 26 comprises a conveying unit for guiding water vapor 18, in particular dry vapor, from a vapor source, in particular the vapor generator 34 or an external vapor source, into the vapor-depositing region 16. Preferably the vapor-depositing apparatus 26, in particular the conveying unit, comprises within the vapor-depositing chamber several vapor inlets 22, 24 for a feeding of the water vapor 18, in particular the dry vapor, into the vapor-depositing region 16. Preferably the vapor-depositing apparatus 26 comprises at least one distributor system 67 within the vapor-depositing chamber. Preferably the vapor-depositing chamber has at least vapor outlets 108, 116, in particular two vapor outlets of the distributor system 67, for letting the water vapor 18, in particular the dry vapor, out of the vapor-depositing region 16. Preferably the vapor-depositing apparatus 26 comprises at least one ventilator 60 for suctioning the water vapor 18, in particular the dry vapor, out of the vapor-depositing region 16. The ventilator 60 is in particular arranged at at least one of the vapor outlets 108, 116. The vapor-depositing chamber in particular comprises a vapor-depositor drain 66 for letting condensed water out of the vapor-depositing chamber. Preferably the vapor-depositing apparatus 26 comprises at least one electric heating element 68 for heating the vapor-depositing chamber, in particular a wall of the vapor-depositing chamber. Preferably the vapor-depositing apparatus 26, in particular the channel unit, comprises at least one valve 56 for a manual separation and connection of the vapor inlets 22, 24 to the vapor source, in particular to the vapor generator 34. Preferably the vapor-depositing apparatus 26, in particular the channel unit, comprises at least one inlet valve 20. The inlet valve 20 is in particular configured for a regulation of a vapor parameter of the water vapor 18, in particular the dry vapor. In particular, the inlet valve 20 is controlled by the control or regulation unit 62. The inlet valve 20 is preferably realized as a pneumatic regulating valve. Preferably the vapor-depositing apparatus 26 comprises at least one pressure sensor 58 for a monitoring of a pressure of the water vapor 18, in particular the dry vapor. The pressure sensor 58 is in particular arranged between the inlet valve 20 and the vapor inlets 22, 24, in particular outside the vapor-depositing chamber. The pressure sensor 58 is in particular connected to the control or regulation unit 62. Preferably the conveying unit comprises a drain 64, in particular with a pressure relief valve, for letting water vapor 18, in particular the dry vapor, out of the conveying unit. Optionally the vapor-depositing apparatus 26 comprises at least one sensor element in the vapor-depositing region 16. The sensor element is embodied, for example, as a temperature feeler, as an infrared sensor, as an infrared camera, or the like, in particular for registering a temperature of the water vapor 18, in particular the dry vapor, of the filament 12 and/or of an inner wall of the vapor-depositing chamber. For example, the sensor element is realized as a further pressure sensor for detecting a pressure of the water vapor 18, in particular the dry vapor, in the vapor-depositing region 16. For example, the sensor element is realized as a humidity sensor for detecting a humidity of the water vapor 18, in particular the dry vapor. In particular, the sensor element is connected to the control or regulation unit 62.

FIG. 3 shows the vapor generator 34. The vapor generator 34 in particular comprises a water inlet 72 for an inlet of liquid water into the vapor generator 34. Preferably the vapor generator 34 comprises at least one feedwater tank 74 for an interim storage of the water. In particular, the water inlet 72 opens into the feedwater tank 74. Preferably the vapor generator 34 comprises at least one feedwater heating element in the feedwater tank 74 for a pre-heating of the water in the feedwater tank 74. Preferably the vapor generator 34 comprises at least one feedwater temperature sensor 80 for a monitoring of a temperature of the water in the feedwater tank 74. Preferably the vapor generator 34 comprises at last one feedwater temperature adjuster 86, in particular an electric switch for an activation or deactivation of the feedwater heating element, for an adjustment of a feedwater temperature of the water in the feedwater tank 74 by the control or regulation unit 62. Particularly preferably, for producing the water vapor 18, in particular the dry vapor, the water in the feedwater tank 74 is heated to a temperature between 50° C. and 70° C.

Preferably the vapor generator 34 comprises a vaporizer 76, in particular for a vaporization of the water from the feedwater tank 74. In particular, the feedwater tank 74 is fluidically connected to the vaporizer 76. Preferably the vapor generator 34 comprises at least one vaporizer heating element in the vaporizer 76 for a vaporization of the water. Preferably the vapor generator 34 comprises at least one vaporizer temperature sensor 82 for a monitoring of a temperature of a saturated vapor generated by the vaporizer 76. Preferably the vapor generator 34 comprises at last one vaporizer temperature adjuster 88, in particular an electric switch for an activation or deactivation of the vaporizer heating element, for an adjustment of a saturated-vapor temperature of the saturated vapor by the control or regulation unit 62. Especially preferentially, for a production of the water vapor 18, in particular the dry vapor, the saturated vapor is heated to a temperature between 130° C. and 180° C. Particularly preferably the control or regulation unit 62 defines a setpoint value for the saturated-vapor temperature of the saturated vapor depending on a pressure of the saturated vapor, in particular a set pressure of the water vapor 18, in particular the dry vapor. Preferably the vapor generator 34 comprises a water bypass 100, which is connected to the vaporizer 76, for letting water out of the vaporizer 76. The water bypass 100 preferably comprises a pneumatic regulating valve, which is in particular controlled by the control or regulation unit 62. Preferentially the vapor generator 34 comprises a vapor bypass, in particular with a pressure relief valve, which is connected to the vaporizer 76, for letting vapor out of the vaporizer 76. The vapor generator 34 in particular comprises a compensating reservoir 94. The water bypass 100 preferably opens into the compensating reservoir 94. The vapor bypass 102 preferably opens into the compensating reservoir 94. The compensating reservoir 94 in particular has a generator vapor outlet 96 for letting vapor, in particular vapor not used and/or not usable in the course of the method 10, out of the vapor generator 34. The compensating reservoir 94 in particular comprises a generator water drain 98 for letting water out of the vapor generator 34.

The vapor generator 34 preferably comprises a superheater 78, in particular for an overheating of the saturated vapor from the vaporizer 76. In particular, the superheater 78 is fluidically connected to the vaporizer 76. Preferably the vapor generator 34 comprises at least one dry-vapor heating element in the superheater 78 for an overheating of the saturated vapor. Preferably the vapor generator 34 comprises at least one dry-vapor temperature sensor 84 for a monitoring of a temperature of the water vapor 18, in particular the dry vapor, generated by the superheater 78. For an adjustment of a temperature of the water vapor 18, in particular the dry vapor, by the control or regulation unit 62, the vapor generator 34 preferably comprises at least one dry-vapor temperature adjuster 90, in particular an electric switch for an activation or deactivation of the dry-vapor heating element. Particularly preferably the water vapor 18, in particular the dry vapor, is heated to a temperature between 180° C. and 300° C. Especially preferentially the control or regulation unit 62 defines a setpoint value for the temperature of the water vapor 18, in particular the dry vapor, depending on a set pressure of the water vapor 18, in particular the dry vapor. A dry-vapor outlet of the superheater 78 is in particular connected to the vapor-depositing apparatus 26. Preferably the vapor generator 34 comprises a dry-vapor bypass 92 that is connected to the superheater 78 for letting the water vapor 18, in particular the dry vapor, out of the superheater 78. The dry-vapor bypass 92 preferably comprises a pneumatic regulating valve, which is in particular controlled by the control or regulation unit 62. The dry-vapor bypass 92 preferably opens into the compensating reservoir 94.

FIG. 4 shows a flow chart of the method 10. Preferentially the method 10 is configured for producing a cohort of filaments 12. The method 10 in particular comprises a raw material processing step 118, in which the raw material processing station 30 spins the filament 12, in particular a cohort of filaments 12. The method 10 comprises at least one stretching step 14. In the stretching step 14 the at least one filament 12 is stretched, in particular by means of the frontward filament conveyor 32 and the rearward filament conveyor 38. In particular, the frontward filament conveyor 32 and the rearward filament conveyor 38 subject a section of the filament 12 situated in the vapor-depositing region 16 to a tensile strain along the transport path. During stretching, the at least one filament 12 is in the vapor-depositing region 16 flown around with the water vapor 18, in particular the dry vapor. At least one vapor parameter of the water vapor 18, in particular the dry vapor, situated in the vapor-depositing region 16 is controlled so as to counteract a formation of droplets on the at least one filament 12. The method 10 comprises a further stretching step 15. In the further stretching step 15, the at least one filament 12 is in particular stretched once more, in particular by the rearward filament conveyor 38 and the further filament conveyor 42. While the at least one filament 12 is being stretched, it is flown around by hot air, in particular via the hot-air oven 40. In particular, the rearward filament conveyor 38 and the further filament conveyor 42 subject a section of the filament 12 that is situated in the hot-air oven 40 to a tensile strain along the transport path. The method optionally comprises a fibrillation 120 of the filament 12 that is realized as a ribbon. The fibrillation 120 is carried out by the fibrillation device 36. In particular in a formation of the filament 12 as a monofilament, the fibrillation 120 is omitted. The fibrillation 120 is preferably carried out after the further stretching step 15. The method 10 comprises a fixing step 122. During the fixing step 122, the at least one filament 12 is flown around with hot air or with the water vapor 18, in particular the dry vapor, in particular by means of the fixing station 44. Optionally, in particular if hot air is used in the fixing step 122, the method 10 comprises a further fixing step 124, in which the filament 12 is once more flown around with hot air, in particular by means of the further fixing station 46. Preferably the method 10 comprises a coating step 126. In particular, in the coating step 126 the coating device 50 applies a preparation liquid onto the filament 12. The method 10 optionally comprises a sorting step 128. In the sorting step 128, the cohort sorter 52 assigns the individual filaments 12 of the cohort to a bobbin body, in particular to respectively one bobbin body, of the winding apparatus. The method 10 in particular comprises a winding step 130. In the winding step 130, the winding apparatus 54 winds the filament 12 onto a bobbin body, in particular the winding apparatus 54 winds the individual filaments 12 onto respectively one bobbin body.

The method 10 in particular comprises a vapor generating step 104. In particular, the vapor generator 34 produces the water vapor 18, in particular the dry vapor, in the vapor generating step 104. For an adjustment of the vapor parameter, the water vapor 18, in particular the dry vapor, is heated to a temperature of more than 125° C. before it is let into the vapor-depositing region 16. For an adjustment of the vapor parameter, the water vapor 18, in particular the dry vapor, is overheated before it is let into the vapor-depositing region 16. The method 10 in particular comprises a vapor feed-in step 106. In the vapor feed-in step 106, the water vapor 18, in particular the dry vapor, is let into the vapor-depositing region 16. In particular, the control or regulation unit 62 controls the inlet valve 20 during the vapor feed-in step 106 for the purpose of a controlled feeding of the water vapor 18, in particular the dry vapor, into the vapor-depositing region 16. The water vapor 18, in particular the dry vapor, is expanded upon entry into the vapor-depositing region 16. In order to achieve a homogeneous distribution of the water vapor 18, in particular the dry vapor, the water vapor 18, in particular the dry vapor, is let into the vapor-depositing region 16 in distributed fashion via the several vapor inlets 22, 24 of the distributor system 67. In particular, in the stretching step 14, the water vapor 18, in particular the dry vapor, flows around the section of the filament 12 that is situated in the vapor-depositing region 16. In particular, the water vapor 18, in particular the dry vapor, let into the vapor-depositing region 16 flows continuously from the vapor inlets 22, 24 to the vapor outlets 108, 116. In particular, the method 10 comprises a vapor removal step 110. The water vapor 18, in particular the dry vapor, is actively removed, in particular suctioned, from the vapor-depositing region 16. In the vapor removal step 110, the ventilator 60 suctions the water vapor 18, in particular the dry vapor, out of the vapor-depositing region 16.

Preferably the control or regulation unit 62 executes a pressure regulation 114. In particular, in the course of the pressure regulation 114, the control or regulation unit 62 controls the ventilator 60 and/or the inlet valve 20 and optionally the vapor generator 34. For a letting-in of the water vapor 18, in particular the dry vapor, into the vapor-depositing region 16, the inlet valve 20 is regulated depending on the vapor parameter. In particular, the control or regulation unit 62 executes the pressure regulation 114 in order to create a constant overpressure relative to the atmosphere in the vapor-depositing region 16, and in particular in order to support a homogeneous distribution of the water vapor 18, in particular the dry vapor. Preferably the control or regulation unit 62 executes a temperature regulation 112. In the course of the temperature regulation 112, the control or regulation unit 62 in particular controls the vapor generator 34 and optionally the inlet valve 20 and optionally the heating element 68. A temperature which the water vapor 18, in particular the dry vapor, is brought to before entry into the vapor-depositing region 16 is adjusted depending on the vapor parameter of the vapor-depositing region 16. In particular, the control or regulation unit 62 executes the temperature regulation 112 in order to prevent a cooling of the water vapor 18, in particular the dry vapor, below a threshold value. A temperature of the water vapor 18, in particular the dry vapor, in the vapor-depositing region 16 is maintained above an, in particular pressure-dependent, condensation temperature of the water vapor 18, in particular the dry vapor.

The invention claimed is:

1. A method for producing at least one filament, in particular an artificial-lawn filament, a packaging tape or a monofilament, with at least one stretching step in which the at least one filament, in particular the artificial-lawn filament, the packaging tape or the monofilament, is stretched, wherein the at least one filament, in particular the artificial-lawn filament, the packaging tape or the monofilament, is in a vapor-depositing region flown around by water vapor before and/or during the at least one stretching step, wherein at least one vapor parameter of the water vapor located in the vapor-depositing region, in particular in the form of dry vapor, is controlled so as to counteract a formation of droplets on the at least one filament, wherein the vapor parameter is monitored by at least one sensor element of a vapor-depositing apparatus, wherein a control or regulation unit of the vapor-depositing apparatus or of a filament-production installation comprising the vapor-depositing apparatus adjusts the vapor parameter such that a condensation of the water vapor on the filament is counteracted.

2. The method according to claim 1, wherein for an adjustment of the vapor parameter, the water vapor, in particular the dry vapor, is heated to a temperature of more than 125° C. before entry into the vapor-depositing region.

3. The method according to claim 1 or 2, wherein for an adjustment of the vapor parameter, the water vapor is overheated before entry into the vapor-depositing region, in particular in order to generate dry vapor.

4. The method according to claim 1, wherein in at least one method step, a temperature which the water vapor, in particular the dry vapor, is brought to before entry into the vapor-depositing region is adjusted depending on the vapor parameter of the vapor-depositing region.

5. The method according to claim 1, wherein the water vapor, in particular the dry vapor, is expanded upon entry into the vapor-depositing region.

6. The method according to claim 1, wherein an inlet valve for letting the water vapor, in particular the dry vapor, into the vapor-depositing region is regulated depending on the vapor parameter.

7. The method according to claim 1, wherein a temperature of the water vapor, in particular the dry vapor, in the vapor-depositing region is maintained above a condensation temperature of the water vapor, in particular the dry vapor.

8. The method according to claim 1, wherein the water vapor, in particular the dry vapor, is actively removed, in particular suctioned, out of the vapor-depositing region.

9. The method according to claim 1, wherein in order to achieve a homogeneous distribution of the water vapor, in particular the dry vapor, the water vapor, in particular the dry vapor, is let into the vapor-depositing region in distributed fashion via several vapor inlets.

10. The method according to claim 1, comprising a further stretching step, before and/or during which the at least one filament, in particular the artificial-lawn filament, the packaging tape or the monofilament, is flown around by hot air.

11. The method according to claim 1, comprising at least one fixing step, during which the at least one filament, in particular the artificial-lawn filament, the packaging tape or the monofilament, is flown around by hot air or water vapor, in particular dry vapor.

12. A vapor-depositing apparatus for a filament-production installation, in particular an extrusion spinning installation, for the production of at least one filament, in particular an artificial-lawn filament, a packaging tape or a monofilament, following a method according to claim 1, with at least one control or regulation unit, which is configured to adjust the vapor parameter such that a condensation of the water vapor on the filament can be counteracted, and with at least one vapor generator or at least one heating and/or cooling aggregate, the vapor generator being configured to vaporize water for a production of the water vapor, the heating and/or cooling aggregate being configured to adapt, before entry into the vapor-depositing region, the temperature of the water vapor obtained from an external vapor source.

13. A filament-production installation, in particular an extrusion spinning installation, for the production of at least one filament, in particular an artificial-lawn filament, a packaging tape or a monofilament, with a vapor-depositing apparatus according to claim 12 and with at least one raw material processing station for spinning the filament.

14. A method for producing at least one filament, in particular an artificial-lawn filament, a packaging tape or a monofilament, with at least one stretching step in which the at least one filament, in particular the artificial-lawn filament, the packaging tape or the monofilament, is stretched, wherein the at least one filament, in particular the artificial-lawn filament, the packaging tape or the monofilament, is in a vapor-depositing region flown around by water vapor before and/or during the at least one stretching step, wherein at least one vapor parameter of the water vapor located in the vapor-depositing region, in particular in the form of dry vapor, is controlled so as to counteract a formation of droplets on the at least one filament, wherein the vapor parameter is monitored by at least one sensor element of a vapor-depositing apparatus, wherein a control or regulation unit of the vapor-depositing apparatus or of a filament-production installation comprising the vapor-depositing apparatus adjusts the vapor parameter such that a condensation of the water vapor on the filament is counteracted, wherein in order to achieve a homogeneous distribution of the water vapor, in particular the dry vapor, the water vapor, in particular the dry vapor, is let into the vapor-depositing region in distributed fashion via several vapor inlets.

15. A method for producing at least one filament, in particular an artificial-lawn filament, a packaging tape or a monofilament, with at least one stretching step in which the at least one filament, in particular the artificial-lawn filament, the packaging tape or the monofilament, is stretched, wherein the at least one filament, in particular the artificial-lawn filament, the packaging tape or the monofilament, is in a vapor-depositing region flown around by water vapor during the at least one stretching step, wherein at least one vapor parameter of the water vapor located in the vapor-depositing region, in particular in the form of dry vapor, is controlled so as to counteract a formation of droplets on the at least one filament, wherein the vapor parameter is monitored by at least one sensor element of a vapor-depositing apparatus, wherein a control or regulation unit of the vapor-depositing apparatus or of a filament-production installation comprising the vapor-depositing apparatus adjusts the vapor parameter such that a condensation of the water vapor on the filament is counteracted.

* * * * *